US008485396B1

(12) United States Patent
Petrossian et al.

(10) Patent No.: US 8,485,396 B1
(45) Date of Patent: Jul. 16, 2013

(54) COMBINATION STORAGE AND DISPENSING DEVICE FOR LAUNDRY PRODUCTS

(76) Inventors: Nikola Petrossian, Goleta, CA (US); Lili Petrossian, Goleta, CA (US)

( * ) Notice: Subject to any disclaimer, the term of this patent is extended or adjusted under 35 U.S.C. 154(b) by 258 days.

(21) Appl. No.: 13/010,107

(22) Filed: Jan. 20, 2011

(51) Int. Cl.
*B67D 7/06* (2010.01)

(52) U.S. Cl.
USPC ..... 222/192; 222/185.1; 222/465.1; 222/132

(58) Field of Classification Search
USPC ..... 222/130, 132, 185.1, 192, 465.1, 222/575
See application file for complete search history.

(56) References Cited

U.S. PATENT DOCUMENTS

| | | | | | |
|---|---|---|---|---|---|
| 135,617 | A * | 2/1873 | Andrews | 222/130 |
| 449,346 | A * | 3/1891 | Brown et al. | 222/130 |
| 1,022,685 | A * | 4/1912 | Lewis | 222/129 |
| 1,778,248 | A * | 10/1930 | Doughty | 222/132 |
| 2,134,865 | A * | 11/1938 | Essery | 222/130 |
| 3,749,211 | A * | 7/1973 | Cima | 190/109 |
| 4,143,795 | A * | 3/1979 | Casebier | 222/143 |
| 4,819,833 | A * | 4/1989 | Huddleston et al. | 222/155 |
| 4,841,661 | A * | 6/1989 | Moore | 43/54.1 |
| 4,998,647 | A * | 3/1991 | Sharp | 222/143 |
| D316,466 | S | 4/1991 | Veasey | |
| 5,193,670 | A * | 3/1993 | Fong | 206/0.81 |
| 5,388,902 | A * | 2/1995 | Huebschen et al. | 312/332 |
| D356,193 | S | 3/1995 | Reynolds | |
| 5,529,219 | A | 6/1996 | Ward | |
| 5,642,762 | A | 7/1997 | Greenberg et al. | |
| 5,649,643 | A | 7/1997 | Ridgeway | |
| 5,746,353 | A | 5/1998 | Cheok et al. | |
| 6,474,760 | B2 * | 11/2002 | Rauls | 312/330.1 |
| 6,601,737 | B1 * | 8/2003 | Sandler | 222/192 |
| 6,814,261 | B1 * | 11/2004 | Gebrayel | 222/181.3 |
| 6,951,294 | B1 | 10/2005 | Laberinto | |
| 7,415,794 | B1 * | 8/2008 | Thompson | 43/54.1 |
| 7,559,442 | B1 * | 7/2009 | Plummer | 222/288 |
| 2009/0050638 | A1 * | 2/2009 | Smith et al. | 220/636 |

* cited by examiner

*Primary Examiner* — Kevin P Shaver
*Assistant Examiner* — Patrick M Buechner

(57) ABSTRACT

A combination storage and dispensing device for laundry products featuring a housing with a plurality of snap-tight drawers for holding various items including measuring cups and coins, liquid dispensing units for storing and dispensing liquid-based laundry products, and powder compartments for holding and dispensing powder-based laundry products. The drawers may be divided into sub-sections via dividers. The liquid dispensing units each have an inner cavity, a dispensing unit opening with a snap-tight dispensing unit top, a spout, and a downwardly sloped wall in the inner cavity. The spout is positioned near the sloped wall. The powder compartments each have an opening and a snap-tight lid. Lids are pivotally disposed in the top of the housing for covering the snap-tight dispensing tops of the liquid dispensing units.

1 Claim, 5 Drawing Sheets

COMBINATION STORAGE AND DISPENSING DEVICE FOR LAUNDRY PRODUCTS

FIELD OF THE INVENTION

The present invention is directed to a combination storage and dispensing device, more particularly to a transportable caddy for storing and dispensing laundry products. Briefly, the caddy is a compartmentalized container that has the capability to hold and dispense laundry washing products (e.g., powder detergents, liquid detergents, color bleach, whitening bleach, fabric softener, delicate fabric detergent, and other products). The device also includes a compartment that can hold laundry dryer sheets, and drawers for holding items such as quarters for laundry machines, keys, cell phones, stain remover bottles, and other various items. The device of the present invention is lightweight and ergonomically constructed so as to make laundry tasks easier. The device of the present invention eliminates the need to carry multiple bulky and oversized laundry cleaning supplies from apartments, dormitories, or various other places to the laundry facilities or local Laundromats. The device is an ergonomically friendly and lightweight product that facilitates the laundry process, making it easier and less physically challenging. The device has the ability to house various products in an easy to access, transportable, and space-saving unit.

BACKGROUND OF THE INVENTION

It can be very physically challenging to lug a plurality of bulky and heavy laundry products to a laundry facility (e.g., a Laundromat) from a home, apartment, dormitory, and/or the like. The present invention features a combination storage and dispensing device for laundry products. The device of the present invention is a compartmentalized container that has the capability to hold and dispense laundry washing products. The various compartments can hold powder detergents, liquid detergents, color bleach, whitening bleach, fabric softener, delicate fabric detergent, and other products. The device also includes a compartment that can hold laundry dryer sheets. As an added feature, the device has drawers giving it the ability to hold items such as quarters for laundry machines, keys, cell phones, stain remover bottles, and other various items. The device of the present invention is lightweight and ergonomically constructed so as to make laundry tasks easier.

The device of the present invention can make the process of washing clothes at a laundry facility more simple and efficient (e.g., the device can help eliminate the need to carry multiple heavy, bulky and/or oversized laundry products). For example, if an individual lives in an apartment where laundry machines are not present (e.g., not present in the apartment or not present in the apartment complex), the individual must carry all of his/her laundry products (in addition to the clothes) with him/her each time he/she goes to do the laundry. Usually these products are large, heavy, and bulky containers. Sometimes, the process of going to do the laundry can take the individual several trips from the apartment to the laundry facility. With the device of the present invention, this tedious and time consuming process becomes more efficient and less physically challenging. Also, at times when laundry detergents are left at the laundry facility they can be taken or used by others without permission. Thus, an individual who does not want to lug his/her laundry bottles back and forth to the facility runs the risk of having those products used or stolen. Having a compact, efficient, ergonomically friendly and lightweight product, such as the device of the present invention, makes the process of washing clothes at a laundry room in the apartment complex or a laundry facility elsewhere much easier, more efficient, and less time consuming.

The device of the present invention eliminates the need to carry multiple bulky and oversized laundry cleaning supplies from apartments, dormitories, or various other places to the laundry facilities or local Laundromats. The device is an ergonomically friendly and lightweight product that facilitates the laundry process, making it easier and less physically challenging. The device has the ability to house various products in an easy to access, transportable, and space-saving, unit.

The device of the present invention has the potential to be purchased and used by various demographics, specifically individuals living in apartments, condos, townhouses that have communal laundry facilities, people who use public Laundromats, and college and university students living away from home in dorms or rental units. This device can help students save time, giving them more time for important tasks such as schoolwork. Even individuals in single-family homes may find the device of the present invention particularly useful. For example, such individuals may enjoy the ergonomic features of the device, the space-saving features, and the like. The device may also be used by individuals when camping, when traveling (e.g., in RVs), and even when boating. It may also be used by truck drivers to help them to easily do laundry at truck stops.

Briefly, the device of the present invention comprises snap-tight lids with locking mechanisms. Liquid detergents and liquid washing products have liquid dispensing push spouts (or other various types of spouts). The device has a plastic handle, snap tight drawers with a snap lock and push open mechanism, and clear plastic measuring cups.

The device of the present invention is not limited to the configurations described herein. For example, the device of the present invention may have more or less compartments, drawers, and/or be made in various other shapes and sizes.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY

The present invention features a combination storage and dispensing device for laundry products. The device may comprise a housing; a plurality of drawers slidably disposed in the housing, the drawers can be secured in an in position via a snap-lock mechanism, wherein a first drawer is adapted to hold coins, the first drawer being divided into sub-sections via dividers, and a second drawer is adapted to hold measuring cups; one or more liquid dispensing units for storing and dispensing liquid-based laundry products, the liquid dispensing units each have an inner cavity and a dispensing unit opening disposed in a top area of the liquid dispensing units adapted to allow filling of the inner cavity, the inner cavities of the liquid dispensing units each comprise a downwardly sloped wall for causing the liquid-based laundry product to fall via gravity towards a bottom end of the downwardly sloped wall, wherein a snap-tight dispensing unit top is pivotally attached to each of the dispensing unit openings; a spout disposed in each liquid dispensing unit for selectively dispensing the liquid-based laundry product from the inner cavity of the liquid dispensing unit when desired, the spout is positioned near the bottom end of the downwardly sloped wall of the inner cavity of the liquid dispensing unit but sufficiently high enough so as to allow a measuring cup to fit in between the spout and a bottom surface of the housing; one or more powder compartments for holding and dispensing powder-based laundry products, the powder compartment has an inner cavity and a powder compartment opening disposed in a top area for providing access to the inner cavity, wherein a powder compartment lid is pivotally attached to the powder compartment opening, the powder compartment lid can be secured in a closed position via a snap-lock mechanism; a lid pivotally disposed in a top surface of the housing functioning to cover the snap-tight dispensing tops of the liquid dispensing units; and a handle disposed on the top surface of the housing.

In some embodiments, the device can hold various items; the laundry products include powder detergents, liquid detergents, bleach, fabric softener, delicate fabric detergent, dryer sheets. Other items include coins, keys, cell phones, stain remover bottles, measuring cups, or a combination thereof. In some embodiments, the housing is generally rectangular, irregular, or curved in shape. In some embodiments, the device is constructed in a color selected from the group consisting of: red, orange, yellow, green, blue, violet, black, brown, white, or a combination thereof. In some embodiments, the device is constructed from a material comprising plastic, metal, wood, rubber, or a combination thereof. In some embodiments, the drawers comprise a knob, a handle with snap tight locking mechanism.

In some embodiments, the device comprises 1 drawer, 2 drawers, 3 drawers, 4 drawers, 5 drawers, 6 drawers, 7 drawers, 8 drawers, or more than 8 drawers. In some embodiments, the device comprises 1 liquid dispensing unit, 2 liquid dispensing units, 3 liquid dispensing units, 4 liquid dispensing units, 5 liquid dispensing units, 6 liquid dispensing units, 7 liquid dispensing units, 8 liquid dispensing units, or more than 8 liquid dispensing units. In some embodiments, the device comprises 1 powder compartment, 2 powder compartments, 3 powder compartments, 4 powder compartments, 5 powder compartments, 6 powder compartments, 7 powder compartments, 8 powder compartments, or more than 8 powder compartments.

In some embodiments, the device further comprises one or more measuring cups. In some embodiments, the spout is a push spout. In some embodiments, the powder compartment lid can pivot between about 90 degrees to 180 degrees. In some embodiments, the lid can open between about 120 degrees to 180 degrees.

DESCRIPTION OF PREFERRED EMBODIMENTS

Referring now to FIGS. 1-8, the present invention features a combination storage and dispensing device 100 for laundry products. Briefly, the device 100 of the present invention is a compartmentalized container that has the capability to hold and dispense laundry washing products (e.g., powder detergents, liquid detergents, color bleach, whitening bleach, fabric softener, delicate fabric detergent, and other products). The device also includes a compartment that can hold laundry dryer sheets and drawers for holding items such as quarters for laundry machines, keys, cell phones, stain remover bottles, and other various items. The device 100 of the present invention is lightweight and ergonomically constructed so as to make laundry tasks easier (e.g., less physically challenging), more efficient, and less time consuming. For example, the device eliminates the need to carry multiple bulky and oversized laundry cleaning supplies from apartments, dormitories, or various other places to the laundry facilities or local Laundromats. The device 100 has the ability to house various products in an easy to access, transportable, and space-saving unit.

Figure 1:
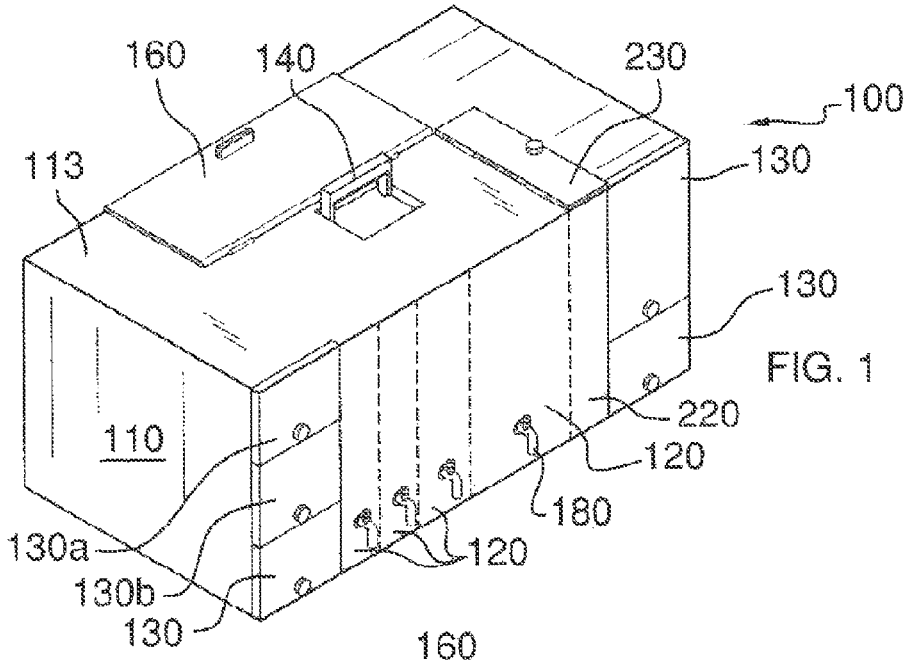
FIG. 1 is a perspective view of the combination storage and dispensing device of the present invention.
Figure 2:
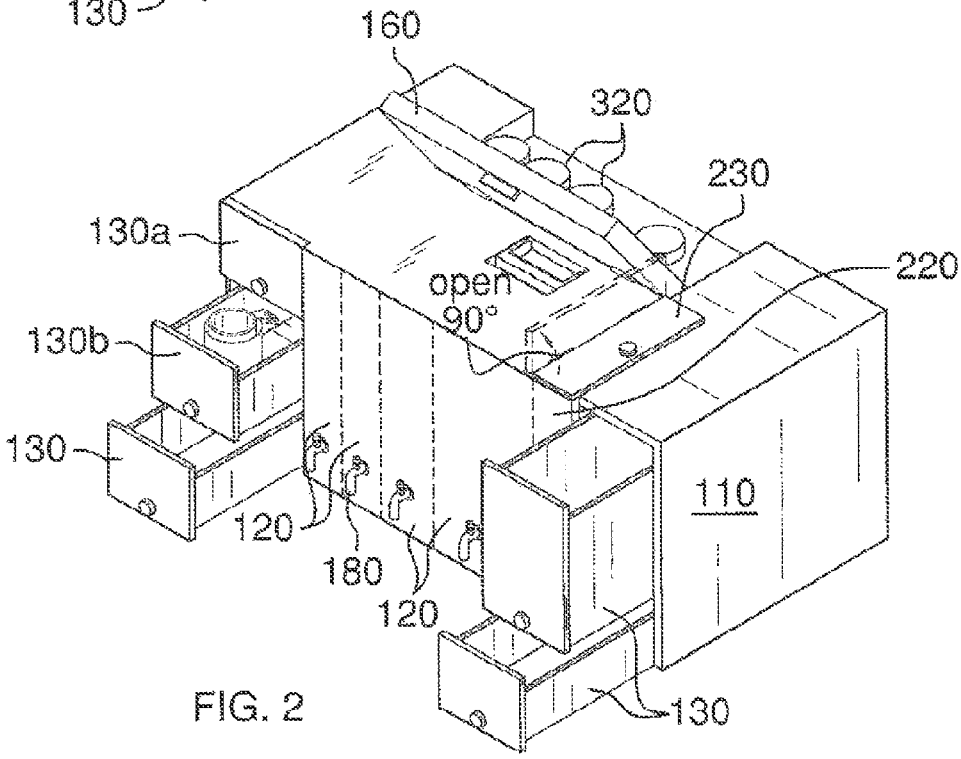
FIG. 2 is an exploded view of the device of FIG. 1.

The combination storage and dispensing device 100 of the present invention comprises a housing 110. As shown in FIG. 1 and FIG. 2, in some embodiments, the housing 110 is generally rectangular in shape. The housing 110 is not limited to this shape and may be irregular in shape, curved, and/or the like. The housing 110 generally has a first side panel, a second side panel, a front surface 111, a back surface 112, a top surface 113, and a bottom surface 114. Disposed in the housing 110 are one or more liquid dispensing units 120, one or more powder compartments 220 (e.g., with lids 230) and one or more storage drawers 130. Disposed in the housing 110, for example on the non-pivoting, non removable top surface 113 of the housing 110, is a handle 140. The handle 140 provides easy transportability.

A plurality of drawers is disposed in the front surface 111 of the housing 110. Drawers are well known to one of ordinary skill in the art. The drawers 130 may comprise a knob 135 (e.g., a handle). The drawers 130 can slide between an in position (in the housing 110 as shown in FIG. 1) and an out position (out of the housing 110 as shown in FIG. 2). In some embodiments, the drawers can be secured in the in position via a locking mechanism 138 (e.g., a snap-tight mechanism). This can help prevent items from falling out of the drawers 130 when the device 100 is being moved or transported.

The liquid dispensing units 120 each have the ability to hold and dispense liquid-based products. The powder compartments 220 have the ability to hold and dispense powder-based products. The drawers 130 can be used for anything, for example for holding powder-based laundry products and liquid measuring cups 139.

Figure 3:
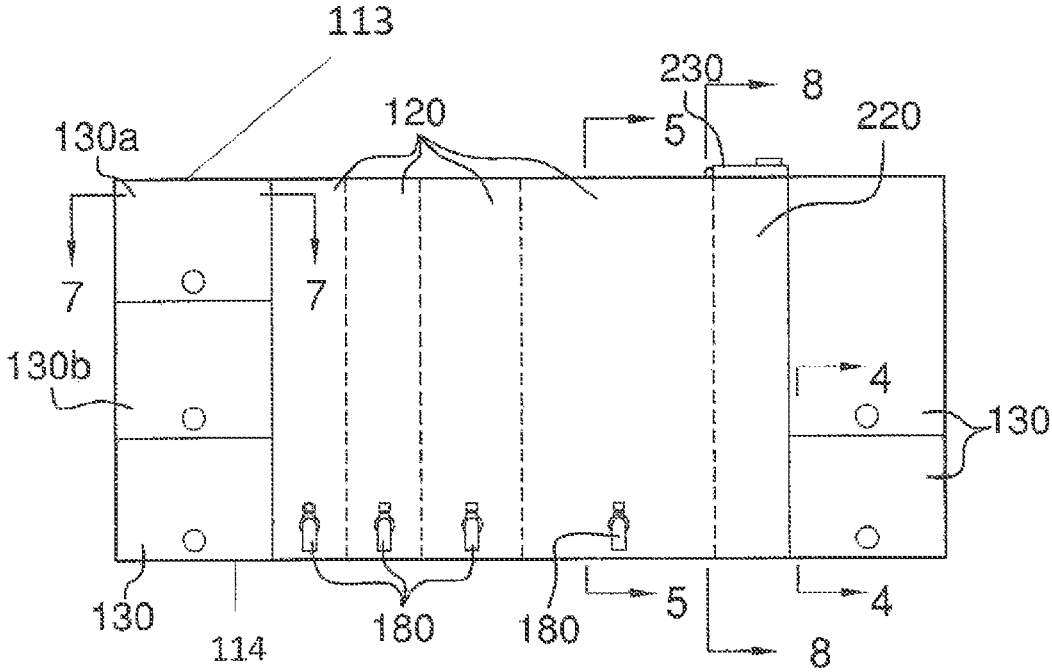
FIG. 3 is a front view of the device of FIG. 1.
Figure 4:
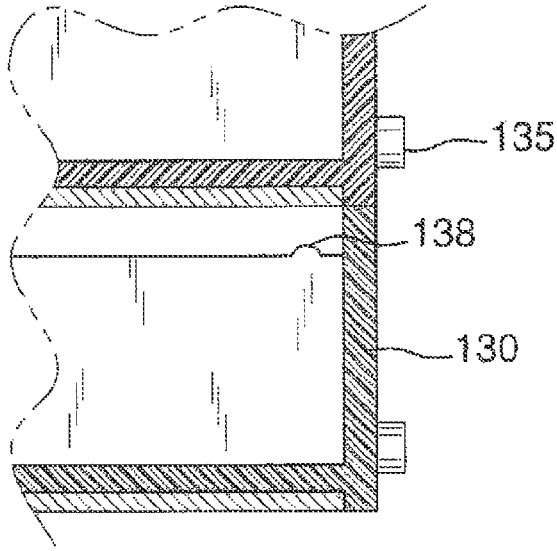
FIG. 4 is a side cross sectional view of drawers of the device of FIG. 1.
Figure 7:
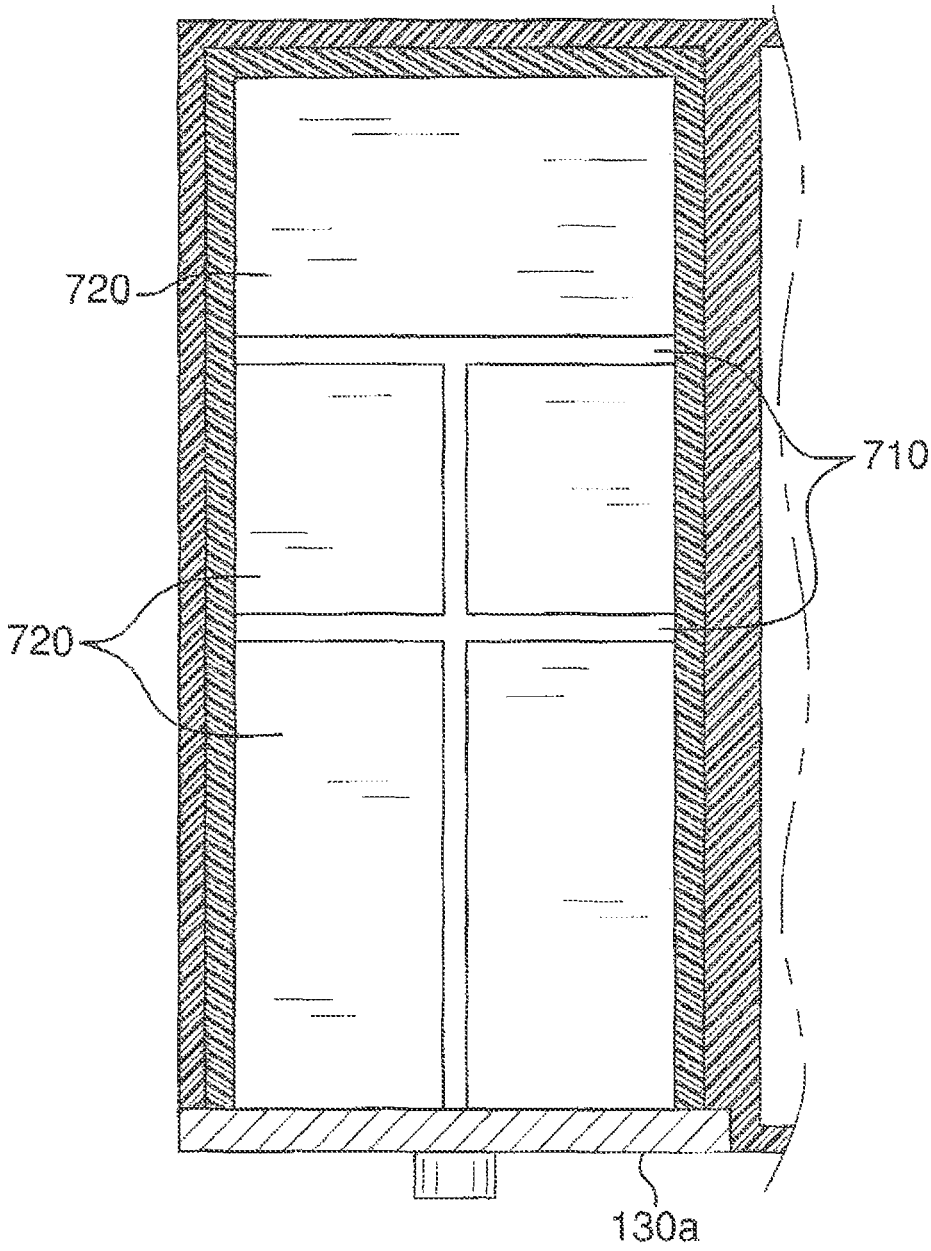
FIG. 7 is a top view of the can drawer of the device of the present invention.

The drawers 130 can also hold various items such as but not limited to powder-based laundry products, dryer sheets, quarters, mobile phones, keys, stain remover bottles, and the like. As shown in FIG. 2 and FIG. 3, a first drawer may be designated for holding coins (e.g., a "coin drawer" 130*a*). In some embodiments, a second drawer is designated for holding measuring cups 139 (e.g., a "measuring cup drawer 130*b*"). As shown in FIG. 7, the coin drawer 130*a* may be divided into various sub-sections 720 via dividers 710. The coin drawer 130*a* is not limited to this configuration.

Figure 8:
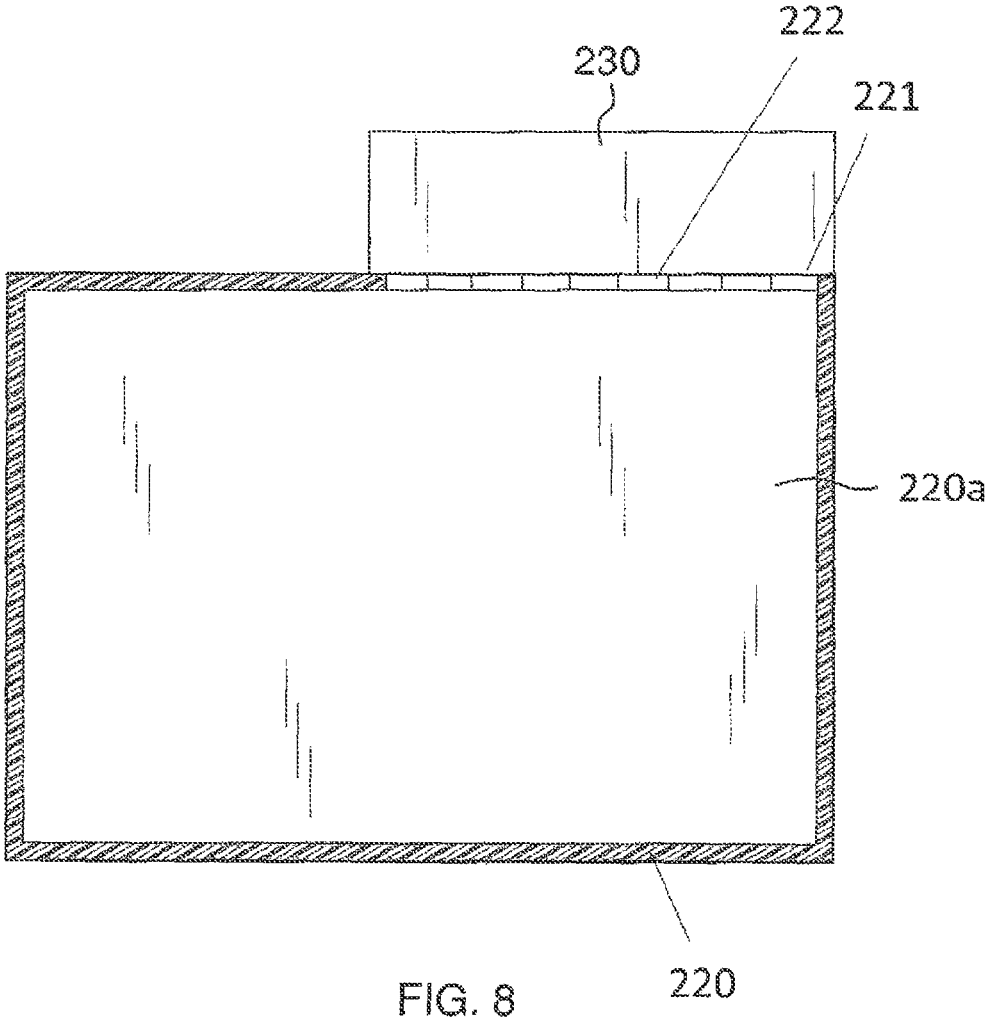
FIG. 8 is a side cross sectional view of the powder compartment of the device of the present invention.

Referring now to FIG. 8, the powder compartments 220 each have an inner cavity 220*a* with the ability to hold powder-based products. A powder compartment opening 221 is disposed in the top of the powder compartment 220, which is sized appropriately to allow for filling and extracting of powder products. A powder compartment lid 230 is pivotally attached to the powder compartment opening 221, for example via a hinge 222. The powder compartment lid 230 can pivot between multiple positions including but not limited to an open position and a closed position respectively allowing and preventing access to the inner cavity 220*a*. In some embodiments, the powder compartment lid 230 may pivot toward the liquid dispenser units 120. The powder compartment lid 230 has a locking mechanism (e.g., a snap-lock mechanism) to keep the powder compartment lid 230 in the dosed position. The powder compartment lid 230 may pivot between about 90 degrees to 120 degrees, between about 120 degrees to 150 degrees, or between about 150 degrees to 180 degrees. The powder compartment lid 230 is not limited to the aforementioned pivot angles.

The liquid dispensing units 120 have a bottom surface (which may be the bottom surface of the housing 110), a first side panel, a second side panel, a front surface (which may be the front surface of the housing 110), a back surface (which may be the back surface of the housing 110), and an inner cavity 128. In the inner cavity 128 of the liquid dispensing units 120 are downwardly sloped walls 129 (see FIG. 5). A dispensing unit opening 322 is disposed toward the back surface 112 in the top area of each liquid dispensing units 120. The dispensing unit openings 322 are sized appropriately to allow for filling the respective inner cavities 128 of the liquid dispensing units 120 with liquid products. A snap-tight dispensing unit top 320 is attached (e.g., pivotally attached) to each dispensing unit opening 322 of the liquid dispensing units 120 (see FIG. 6). The snap-tight dispensing unit tops 320 can move between an open position and a closed position respectively allowing and preventing access to the respective inner cavity 128 of the respective liquid dispensing unit 120. FIG. 6 shows three snap-tight dispensing unit tops 320 in the closed position and one snap-tight dispensing unit top 320 in the open position (far right).

In some embodiments, a lid 160 (e.g., removable lid, pivoting lid) is disposed in the top surface 113 of the housing 110, which functions to cover the snap-tight dispensing unit tops 320 of the liquid dispensing units 120. The lid 160 can move or pivot between an open position and a closed position respectively allowing and preventing access to the snap-tight dispensing unit tops 320 of the liquid dispensing units 120. The lid 160 may open between about 120 degrees to 150 degrees, or between about 150 degrees to 180 degrees. The liquid dispensing unit lid 160 is not limited to the aforementioned pivot angles.

Disposed in each liquid dispensing unit 120 is a spout 180. Spouts are well known to one of ordinary skill in the art. For example, in some embodiments, the spout 180 is a push spout or other standard type of spout. The spout may comprise a valve that can move between an open position and a closed position for respectively allowing and preventing escape of the laundry product from the inner cavity 128 of the liquid dispensing unit 120. Generally the spout 180 is positioned near the bottom surface of the liquid dispensing unit 120. As shown in FIG. 1 and FIG. 2, the spout may be positioned in the front surface of the liquid dispensing unit 120. The spout 180 must be placed high enough from the bottom of the housing 110 in order for the measuring cup 139 to fit under the spout 180 without having to lift the device 100 (see FIG. 5).

Figure 5:
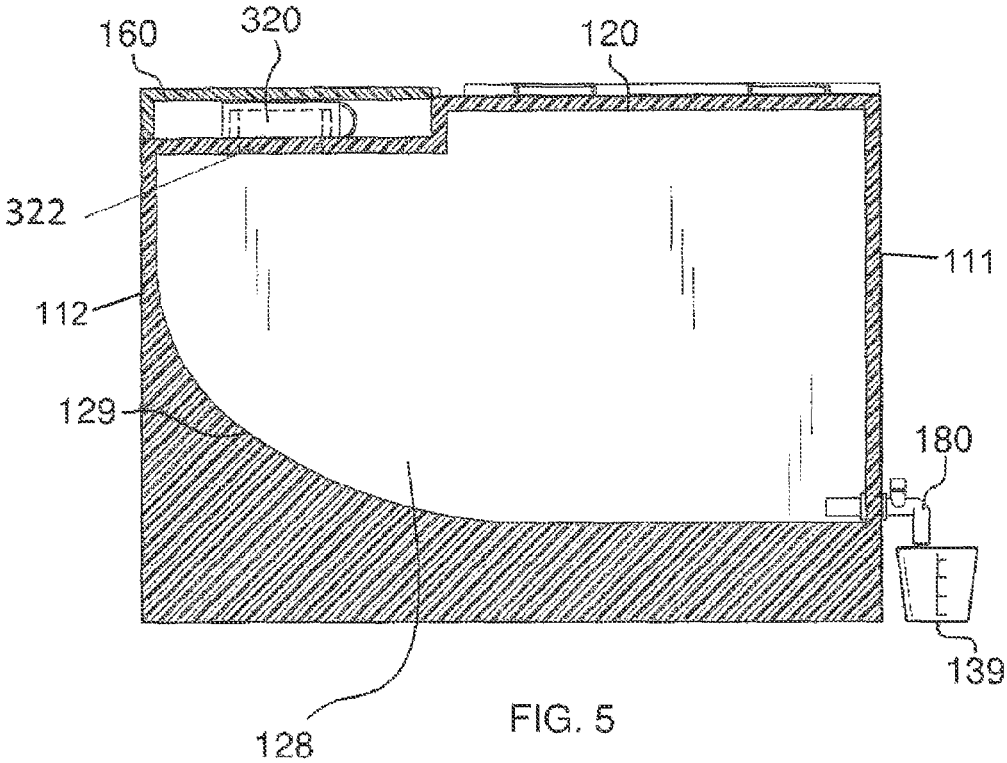
FIG. 5 is a side cross sectional view of a liquid dispensing unit of the device of FIG. 1
Figure 6:
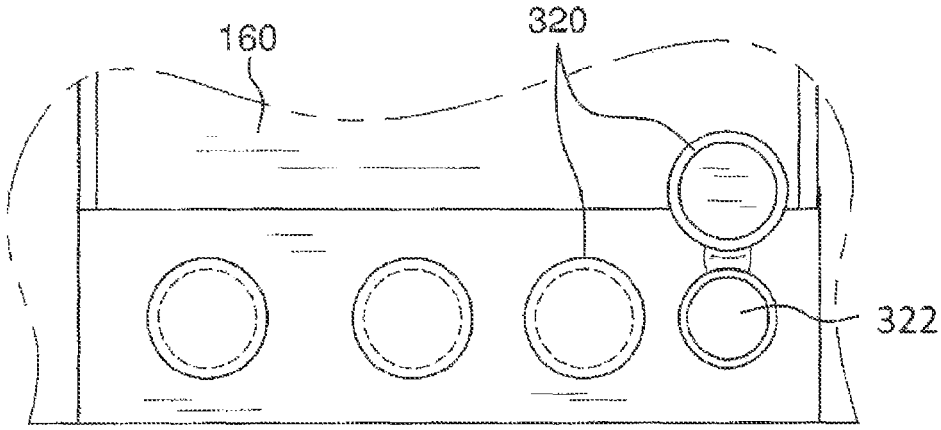
FIG. 6 is a top view of the openings of the device of the present invention.

As shown in FIG. 5, in some embodiments, a downwardly sloped wall 129 is disposed in the inner cavity 128 of the liquid dispensing unit 120. The downwardly sloped wall 129 causes the product to fall via gravity towards the bottom end of the slope. Generally the spout 180 is positioned at the bottom end of the slope. This helps the product in the inner cavity 128 to be directed to the spout 180 for easy dispensing. The internal curved design of the liquid dispensing unit 120 must slope to the bottom section of the inner cavity 128.

As shown in FIG. 1 and FIG. 2, drawers 130 are positioned at the first site panel of the housing 110 and at the second side panel of the housing 110. Several liquid dispensing units 120 and powder compartments 220 are sandwiched between the sets of drawers 130 (e.g., two sets of drawers 130). The present invention is not limited to this configuration. For example, in some embodiments, the device 100 may comprise 1 drawer 130, 2 drawers 130, or 3 drawers 130. In some embodiments, the device 100 comprises 4 drawers 130, 5 drawers 130, 6 drawers 130, 7 drawers 130, 8 drawers 130, or more than 8 drawers 130. In some embodiments, the device 100 may comprise 1 powder compartment 220, 2 powder compartments 220, or 3 powder compartments 220. In some embodiments, the device 100 comprises 4 powder compartments 220, 5 powder compartments 220, 6 powder compartments 220, 7 powder compartments 220, 8 powder compartments 220, or more than 8 powder compartments 220. In some embodiments, the device 100 may comprise 1 liquid dispensing unit 120, 2 liquid dispensing units 120, or 3 liquid dispensing units 120. In some embodiments, the device 100 comprises 4 liquid dispensing units 120, 5 liquid dispensing units 120, 6 liquid dispensing units 120, 7 liquid dispensing units 120, 8 liquid dispensing units 120, or more than 8 liquid dispensing units 120. In some embodiments, the position of the drawers 130, liquid dispensing units 120, and powder compartments 220 are configured differently.

In some embodiments, the liquid dispensing units 120 and/or powder compartments 220 are constructed with capacity to hold enough laundry detergent for a certain number of loads, for example between about 1 to 2 loads, between about 2 to 5 loads, between about 5 to 10 loads, between about 10 to 15 loads, between about 15 to 20 loads, between about 20 to 25 loads, between about 25 to 30 loads, between about 30 to 35 loads, between about 35 to 40 loads, more than 40 loads, etc.

In some embodiments, the device 100 of the present invention further comprises one or more measuring cups having a scale imprint for helping to dispense the various products. The measuring cups may have a specific drawer to be housed.

The device 100 may be constructed in a variety of sizes and from a variety of materials. In some embodiments, the device 100 is constructed from a material comprising a plastic. In some embodiments, the housing 110 is between about 5 to 10 inches in height as measured from the top surface 113 to the bottom surface. In some embodiments, the housing 110 is between about 10 to 12 inches in height as measured from the top surface 113 to the bottom surface. In some embodiments, the housing 110 is more than about 12 inches in height. The device 100 may be constructed in a variety of styles and designs, for example in colors including but not limited to red, orange, yellow, green, blue, violet, black, brown, white, the like, or a combination thereof. The device 100 may be constructed from a variety of materials including but not limited to a material comprising plastic, metal, wood, rubber, the like, or a combination thereof.

In some embodiments, the housing 110 is between about 8 to 10 inches in length as measured from the first side panel to the second side panel. In some embodiments, the housing 110 is between about 10 to 14 inches in length as measured from the first side panel to the second side panel. In some embodiments, the housing 110 is between about 14 to 20 inches in length as measured from the first side panel to the second side panel. In some embodiments, the housing 110 is more than about 20 inches in length. In some embodiments, the housing 110 is between about 5 to 8 inches in width as measured from the front surface to the back surface. In some embodiments, the housing 110 is between about 8 to 10 inches in width as measured from the front surface to the back surface. In some embodiments, the housing 110 is more than about 10 inches in width.

As used herein, the term "about" refers to plus or minus 15% of the referenced number. For example, an embodiment wherein the housing 110 is about 10 inches in width includes a housing 110 that is between 8.5 and 11.5 inches in width.

The following the disclosures of the following U.S. patents are incorporated in their entirety by reference herein: U.S. Pat. No. 6,951,294; U.S. Pat. No. 5,746,353; U.S. Pat. No. 5,649,643; U.S. Pat. No. 5,529,219; U.S. Pat. No. 5,642,762.

Various modifications of the invention, in addition to those described herein, will be apparent to those skilled, in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A combination storage and dispensing device for laundry products, said device consisting of:

(a) a housing (110) having a front surface (111), a back surface (112), and a top surface (113);

(b) a plurality of drawers (130) slidably disposed in the front surface (111) of the housing (110), the drawers (130) can be secured in an in position via a snap-lock mechanism, wherein a first drawer (130*a*) is adapted to hold coins, the first drawer (130*a*) being divided into sub-sections (720) via dividers (710), and a second drawer (130*b*) is adapted to hold measuring cups (139), wherein the second drawer (130*b*) consists of a measuring cup (139) having a scale imprint disposed thereon;

(c) one or more liquid dispensing units (120) for storing and dispensing liquid-based laundry products, the liquid dispensing units (120) each have an inner cavity (128) and a dispensing unit opening (322) disposed in a top area of the liquid dispensing units (120) proximal to the back surface (112) adapted to allow filling of the inner cavity (128), the inner cavities (128) of the liquid dispensing units (120) each consists of a downwardly sloped wall (129) for causing the liquid-based laundry product to fall via gravity towards a bottom end of the downwardly sloped wall (129), wherein a snap-tight dispensing unit top (320) is pivotally attached to each of the dispensing unit openings (322);

(d) a spout (180) disposed in each liquid dispensing unit (120) for selectively dispensing the liquid-based laundry product from the inner cavity (128) of the liquid dispensing unit (120) when desired, the spout (180) is positioned on the front surface (111) near the bottom end of the downwardly sloped wall (129) of the inner cavity (128) of the liquid dispensing unit (120) but sufficiently high enough so as to allow a measuring cup (139) to fit in between the spout (180) and a bottom surface (114) of the housing (110);

(e) one or more powder compartments (220) for holding and dispensing powder-based laundry products, the powder compartment (220) has an inner cavity (220*a*) and a powder compartment opening (221) disposed in a top area for providing access to the inner cavity (220*a*), wherein a powder compartment lid (230) is pivotally attached to the powder compartment opening (221);

(f) a lid (160) pivotally disposed in a top surface (113) of the housing (110) functioning to cover the snap-tight dispensing tops (320) of the liquid dispensing units (120); and (g) a handle (140) disposed on a non-pivoting, non-removable portion of the top surface (113) of the housing (110).

* * * * *